US005215446A

United States Patent [19]

Takahashi et al.

[11] Patent Number: 5,215,446

[45] Date of Patent: Jun. 1, 1993

[54] PIEZOELECTRIC PUMP WHICH USES A PIEZOELECTRIC ACTUATOR

[75] Inventors: Yoshikazu Takahashi, Kasugai; Masahiko Suzuki, Nagoya, both of Japan

[73] Assignee: Brother Kogyo Kabushiki Kaisha, Nagoya, Japan

[21] Appl. No.: 780,975

[22] Filed: Oct. 23, 1991

[30] Foreign Application Priority Data

Nov. 22, 1990 [JP] Japan ..... 2-318739

[51] Int. Cl.[5] ..... F04B 35/04

[52] U.S. Cl. ..... 417/322; 417/413 R

[58] Field of Search ..... 417/322, 413, 474, 475

[56] References Cited

U.S. PATENT DOCUMENTS 3,606,592 9/1971 Madurski et al. ..... 417/413
4,519,751 5/1985 Beckmann et al. ..... 417/322
4,648,807 3/1987 Tippetts et al. ..... 417/322
4,842,493 6/1989 Nilsson ..... 417/322

FOREIGN PATENT DOCUMENTS 3-49957 4/1991 Japan .

*Primary Examiner*—Richard A. Bertsch
*Assistant Examiner*—Charles G. Freay
*Attorney, Agent, or Firm*—Oliff & Berridge

[57] ABSTRACT

The invention relates to a piezoelectric pump using a piezoelectric actuator. The piezoelectric pump comprises an upper pump chamber main body having three pump chambers, a lower pump chamber main body having three pump chambers, and a piezoelectric actuator which has three actuator segments. The piezoelectric actuator is supported between the upper pump chamber main body and the lower pump chamber main body. The resultant piezoelectric pump has a simple and small structure and a high pump efficiency because both of the paired upper and lower pump chambers can be driven by an associated actuator segment.

25 Claims, 16 Drawing Sheets

PIEZOELECTRIC PUMP WHICH USES A PIEZOELECTRIC ACTUATOR

BACKGROUND OF THE INVENTION

1. Field of the Invention

The invention relates to a piezoelectric pump which uses a piezoelectric actuator.

2. Description of Related Art

A conventional piezoelectric pump 200 is shown in FIGS. 11–12 which uses a piezoelectric actuator. FIG. 11 is a perspective view which shows one example of such a conventional piezoelectric pump. FIG. 12 is a longitudinal sectional view of the piezoelectric pump shown in FIG. 11.

Piezoelectric pump 200 is structured to have an upper pump chamber main body 222, lower pump chamber main body 224, two piezoelectric bimorph elements 220A, 220B, inlet valve 226 and discharge valve 228. The pump chamber 254, enclosed by upper pump chamber main body 222, lower pump chamber main body 224, the two piezoelectric bimorph elements 220A, 220B, inlet valve 226 and discharge valve 228, is installed in piezoelectric pump 200.

The piezoelectric bimorph element 220A provides the upper surface of piezoelectric pump 200 and piezoelectric bimorph element 220B provides the lower surface of piezoelectric pump 200.

Inlet opening 201 and discharge opening 202 are formed by upper pump chamber main body 222 and lower pump chamber main body 224, and are installed in both ends of the piezoelectric pump 200 in the longitudinal direction of FIG. 12.

At inlet opening 201, the fluid flows into piezoelectric pump 200. Inlet valve 226 is installed in the inlet opening 201. Inlet valve 226 does not limit the inflow of the fluid into the piezoelectric pump 200, but prevents the outflow, or reverse flow, of the fluid to out of piezoelectric pump 200.

At discharge opening 202, the fluid flows out of the piezoelectric pump 200. Discharge valve 228 is installed in the discharge opening 202. Discharge valve 228 does not affect the outflow of the fluid to the outside of the piezoelectric pump 200 but prevents the inflow of fluid into piezoelectric pump 200, that is, reverse flow.

The piezoelectric bimorph element 220A is constructed from two piezoelectric ceramic boards 230A, 230B, two electrodes 232A, 232B and an electrode 234A. The electrode 234A is between the two piezoelectric ceramic boards 230A, 230B. The electrode 234A and the two piezoelectric ceramic boards 230A, 230B are between the two electrodes 232A, 232B. The electrodes 232A, 232B and the electrode 234A are connected to a AC power supply (not shown). A voltage with the same polarity is applied to the electrodes 232A, 232B from the AC power supply and a voltage having an opposite polarity is applied to the electrode 234A from the AC power supply. The piezoelectric bimorph element 220A flexes vertically, as shown FIG. 12 by the dashed lines, upon application of the voltage from the AC power supply.

The piezoelectric bimorph element 220B is constructed from two piezoelectric ceramic boards 230C, 230D, two electrodes 232C, 232D and an electrode 234B. The electrode 234B is between the two piezoelectric ceramic boards 230C, 230D. The electrode 234A and two piezoelectric ceramic boards 230C, 230D are between the two electrodes 232C, 232D. The electrodes 232C, 232D and the electrode 234B are connected to a AC power supply (not shown). A voltage with the same polarity is applied to the electrodes 232C, 232D from the AC power supply and a voltage having an opposite polarity is applied to the electrode 234B from the AC power supply. The piezoelectric bimorph element 220B also flexes vertically, as shown in FIG. 12 by the dashed lines, upon application of the voltage from the AC power supply.

The movement of the piezoelectric bimorph element 220A only is explained because both the piezoelectric bimorph element 220A and the piezoelectric bimorph element 220B operate in the similar manner.

The piezoelectric bimorph element 220A is polarized, as shown FIG. 12 by the solid line arrows. A voltage of a positive polarity is applied to the electrodes 232A, 232B from the AC power supply and a voltage with a negative polarity is applied to the electrode 234A from the AC power supply. An electric field, which is in the reverse direction of the poling direction, is produced in upper piezoelectric ceramic board 230A and an electric field in the same direction as the poling direction is produced in the lower piezoelectric ceramic board 230B. According to the characteristics of the piezoelectric ceramic board, the upper piezoelectric ceramic board 230A extends in a horizontal direction and the lower piezoelectric ceramic board 230B shrinks in the horizontal direction as shown in FIG. 12. As a result, the piezoelectric bimorph element 220A flexes as shown in the upper dashed lines of FIG. 12.

When a voltage of a negative polarity is applied to the electrodes 232A, 232B from the AC power supply and a voltage having a positive polarity is applied to the electrode 234A from the AC power supply, then, an electric field in the same direction as the poling direction is produced in the upper piezoelectric ceramic board 230A and an electric field in the reverse direction of the poling direction is produced in the lower piezoelectric ceramic board 230B. As a result, the upper piezoelectric ceramic board 230A shrinks in a horizontal direction and the lower piezoelectric ceramic board 230B extends in the horizontal direction, as shown in FIG. 12. As a result, the piezoelectric bimorph element 220A flexes as shown in the lower dashed lines of FIG. 12.

For this piezoelectric pump, the lower piezoelectric bimorph element 220B is controlled to flex in the direction of the lower dashed lines when the upper piezoelectric bimorph element 220A is controlled to flex in the direction of the upper dashed lines (FIG. 12). Moreover, the lower piezoelectric bimorph element 220B is controlled to flex in the direction of the upper dashed lines when the upper piezoelectric bimorph element 220A is controlled to flex in the direction of the lower dashed lines (FIG. 12). The volume of the pump chamber 254 increases and decreases alternately by the flexing movement.

When the volume of the pump chamber 254 increases, a negative pressure is applied to the fluid in the pump chamber 254 and fluid from outside of the piezoelectric pump 200 is drawn from the inlet opening 201 into the pump chamber 254 through inlet valve 226. When the volume of the pump chamber 254 decreases, a positive pressure is applied to the fluid in the pump chamber 254 and the fluid is discharged from the discharge opening 202 through the discharge valve 228 to outside of the piezoelectric pump 200.

However, for the above described piezoelectric pump, at least one piezoelectric bimorph element, or more, is necessary for each pump chamber. Therefore, there is a problem in that the structure becomes complex because of an increased number of parts. In addition, the manufacturing costs rise when a piezoelectric pump having a number of discharge openings is constructed. Moreover, there is a problem that miniaturization of the piezoelectric pump is very difficult because of the increased number of parts.

SUMMARY OF THE INVENTION

An object of the invention is to provide a piezoelectric pump which has a simple and small structure but provides high pump efficiency.

In order to achieve the above object, a piezoelectric pump of the present invention comprises: an upper pump chamber main body which has at least one upper pump chamber; a lower pump chamber main body which has at least one lower pump chamber; and a piezoelectric actuator which is supported between the upper pump chamber main body and the lower pump chamber main body, the piezoelectric actuator having, at least one actuator segment.

According to the piezoelectric pump of the invention thus structured, since the piezoelectric actuator, which has at least one actuator segment, is supported between the upper pump chamber main body and the lower pump chamber main body, both pump chambers can be driven by the piezoelectric actuator and the fluid can be drawn in and discharged efficiently.

BRIEF DESCRIPTION OF THE DRAWINGS

The invention will be described in detail with reference to the following figures wherein.

DETAILED DESCRIPTION OF THE PREFERRED EMBODIMENT

Referring now to the accompanying drawings, a first embodiment of the invention will be explained.

Figure 1:
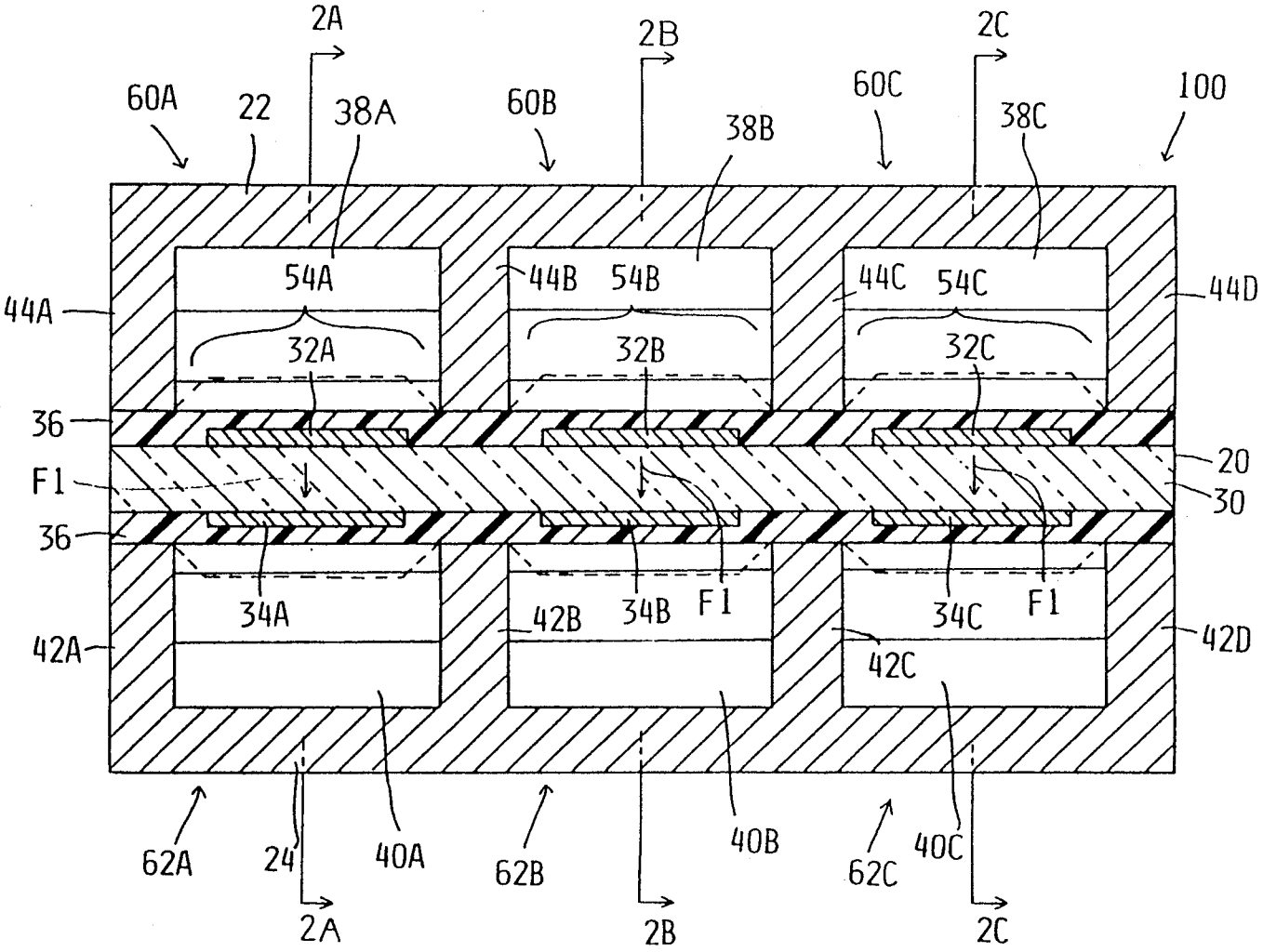
FIG. 1 is a transverse sectional view showing the structure of the piezoelectric pump of a first embodiment of the invention.
Figure 2A:
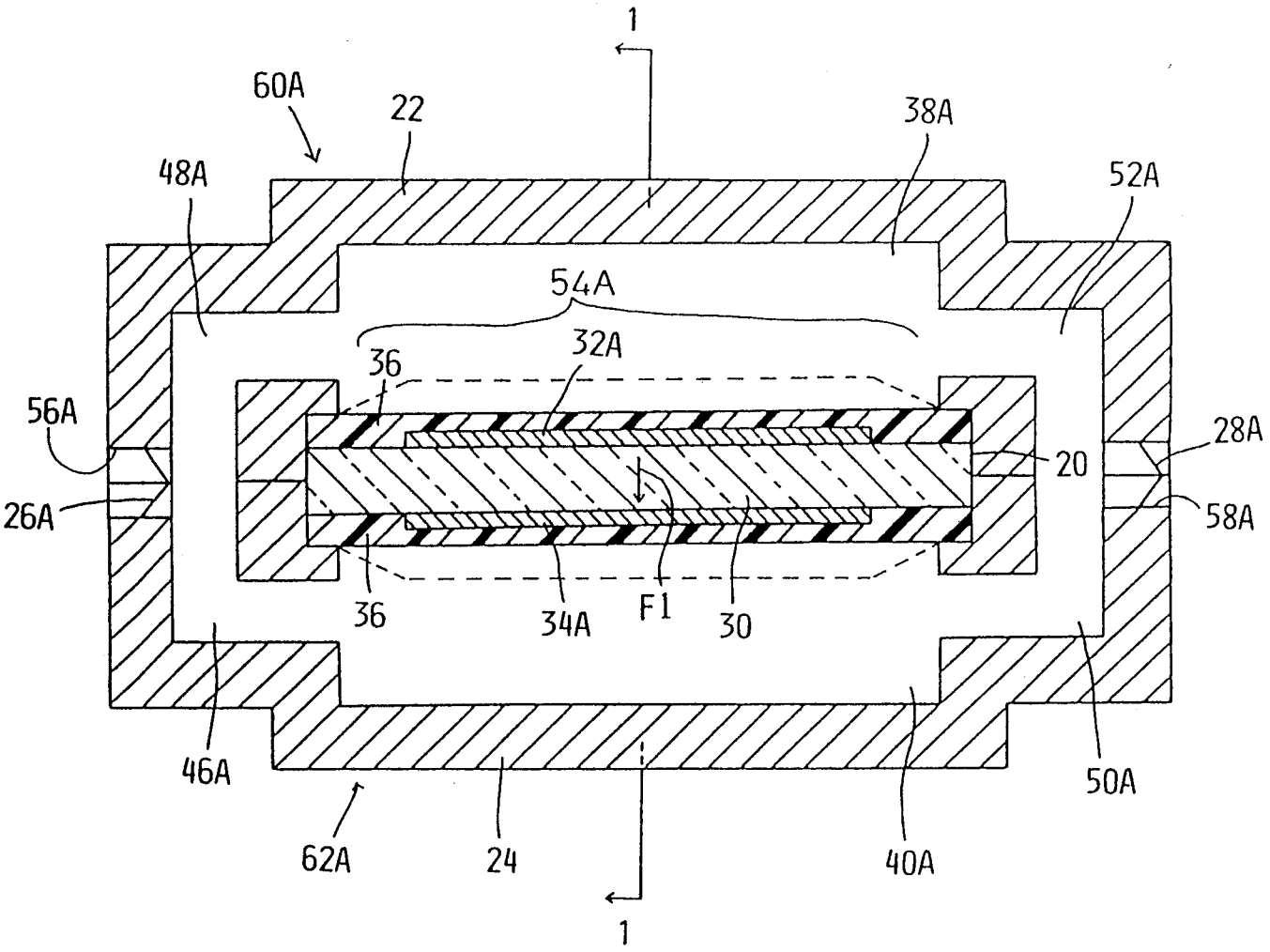
FIGS. 2A–2C are longitudinal sectional views showing the structure of the piezoelectric pump of the first embodiment.
Figure 2B:
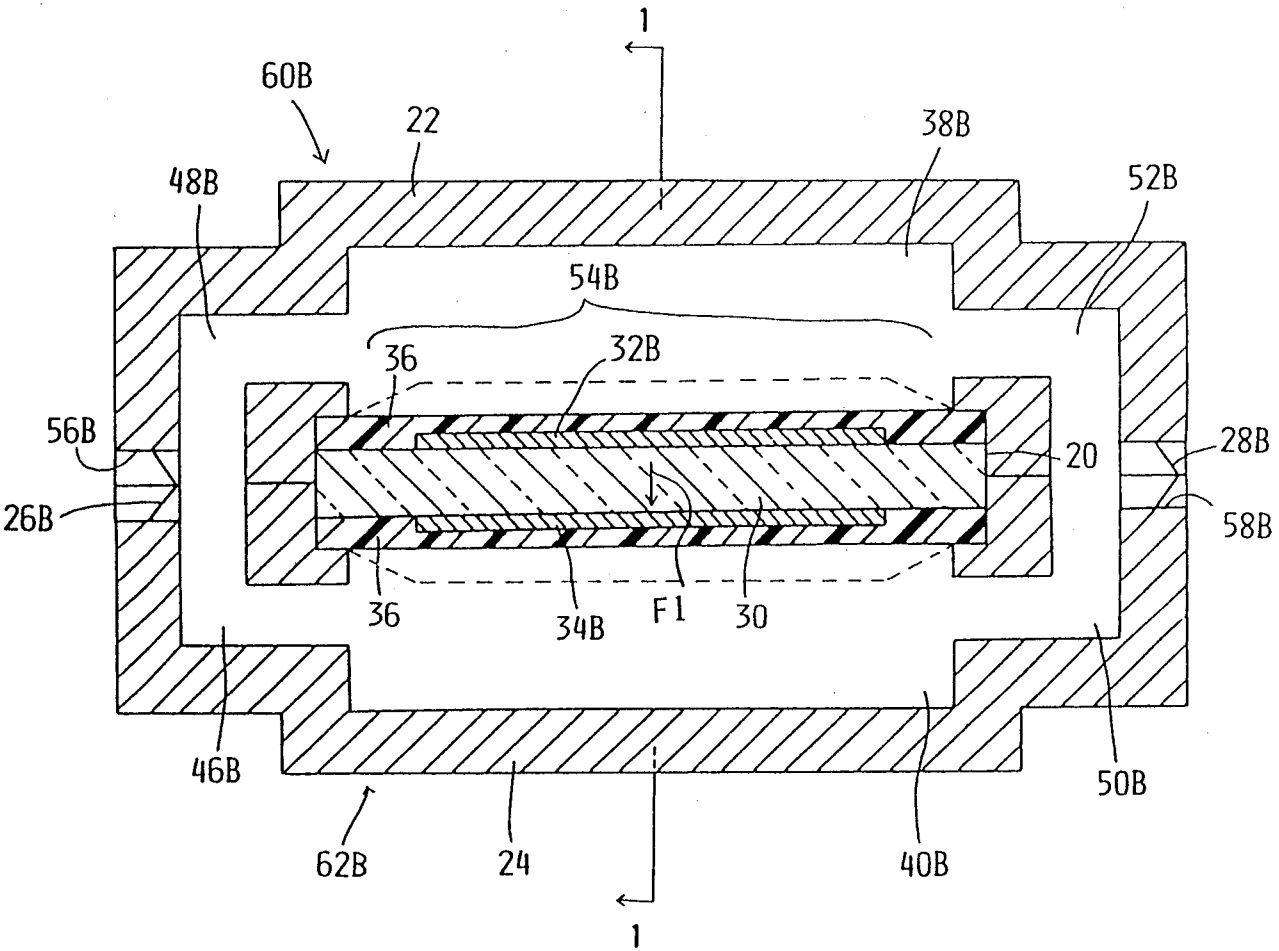
Figure 2C:
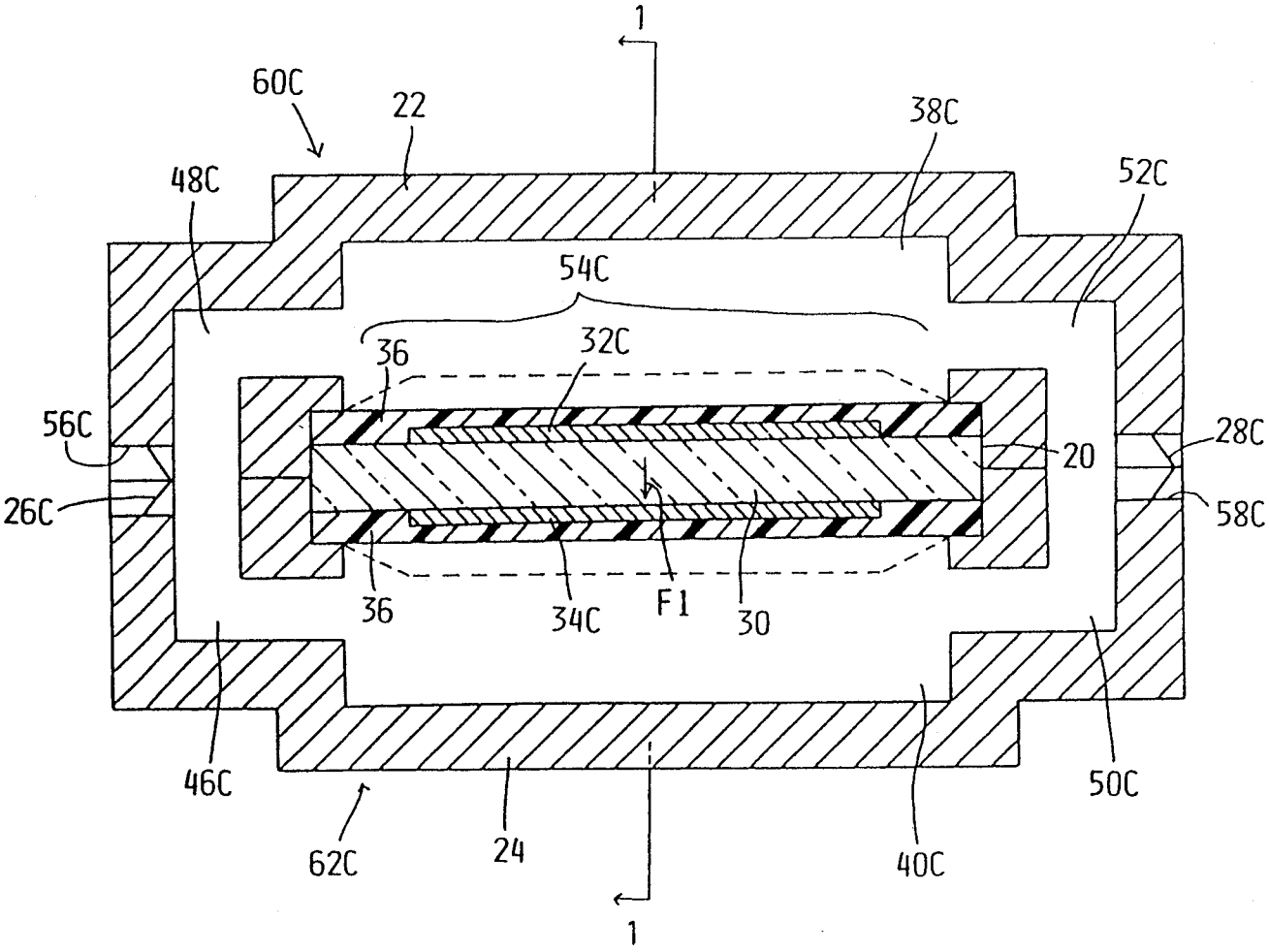
Figure 3:
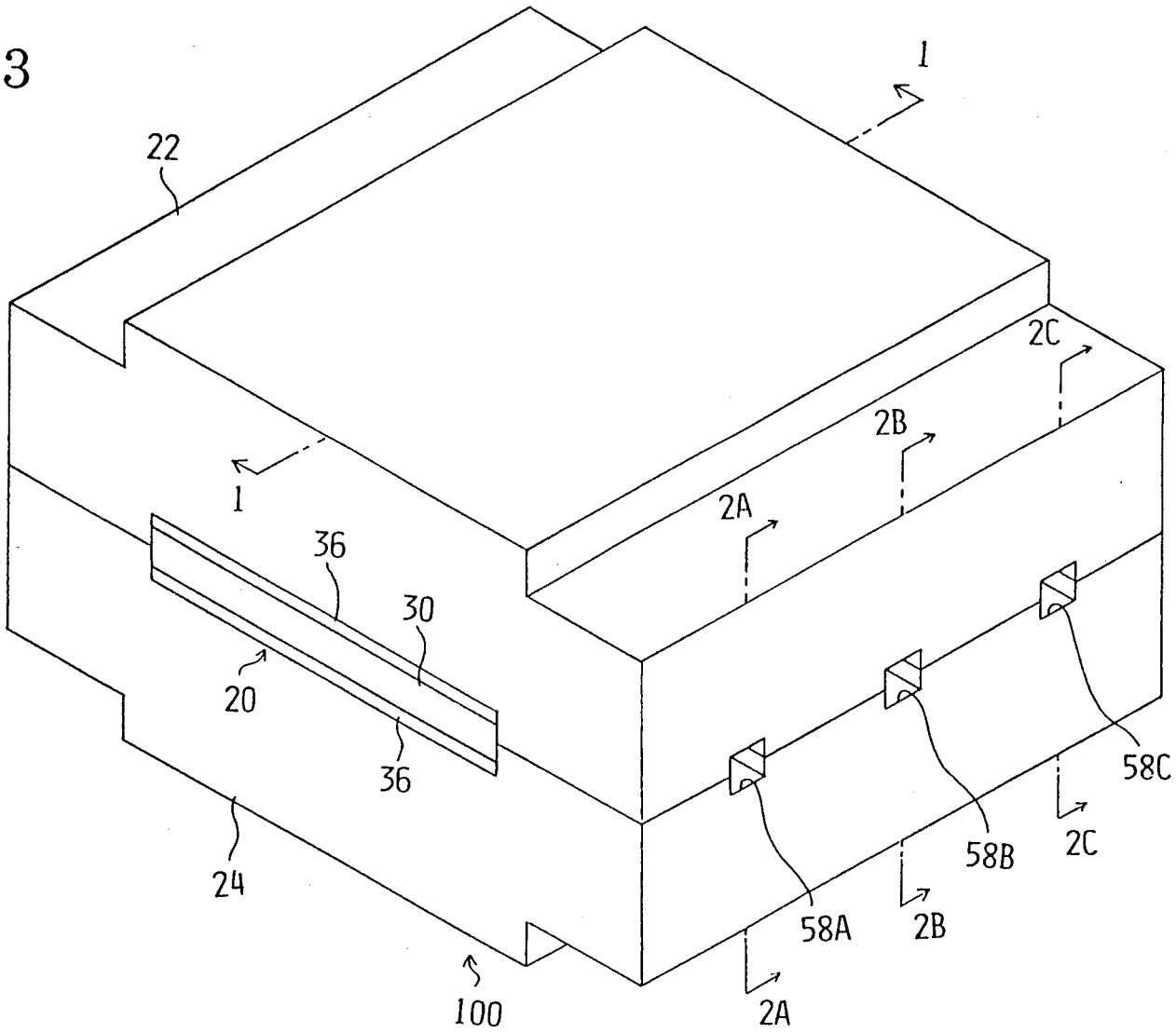
FIG. 3 is a perspective view of the piezoelectric pump of the first embodiment.
Figure 4:
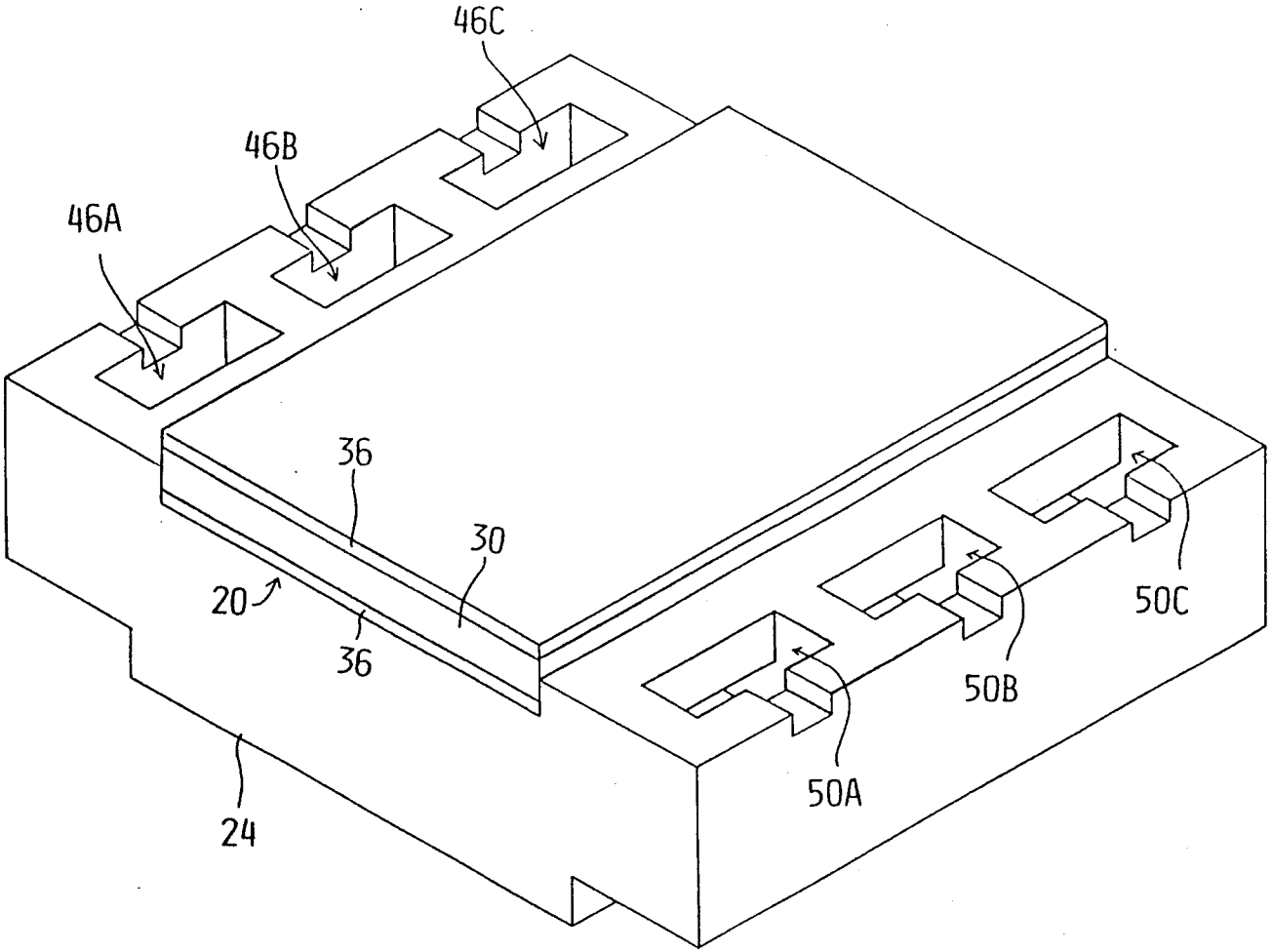
FIG. 4 is a perspective view showing the piezoelectric pump of the first embodiment without the upper pump chamber main body.
Figure 5:
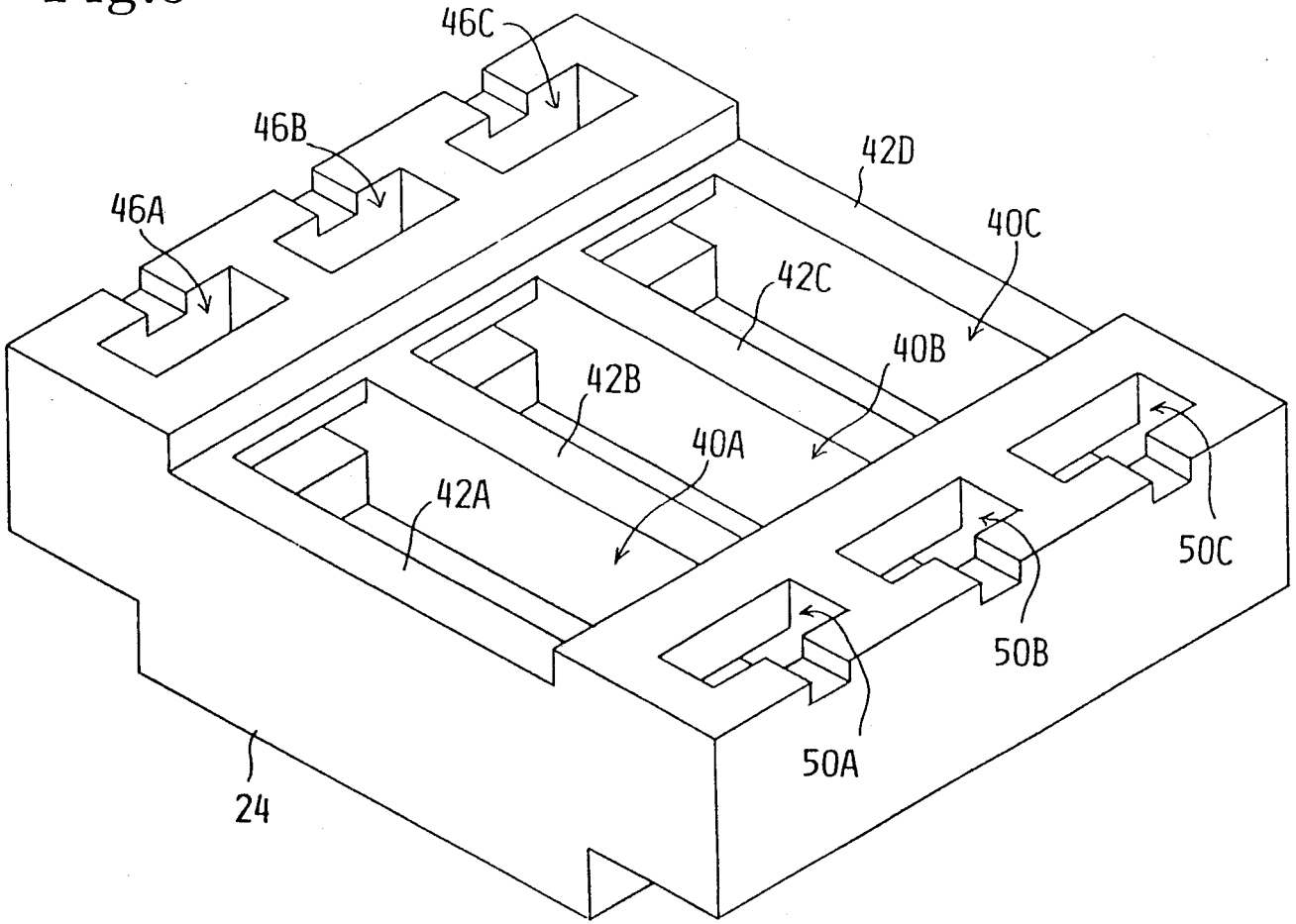
FIG. 5 is a perspective view showing the lower pump chamber main body of the first embodiment.

The structure of the piezoelectric pump of this embodiment will be explained with reference to FIGS. 1 through 5. FIG. 1 is a transverse sectional view showing the structure of the piezoelectric pump of the first embodiment of the invention. FIGS. 2A–2C are longitudinal sectional views showing the structure of the piezoelectric pump of the first embodiment. FIG. 3 is a perspective view of the piezoelectric pump of the first embodiment. FIG. 4 is a perspective view showing the piezoelectric pump of the first embodiment without the upper pump chamber main body. FIG. 5 is a perspective view showing the lower pump chamber main body of the first embodiment.

The piezoelectric pump 100 comprises a piezoelectric actuator 20, an upper pump chamber main body 22, a lower pump chamber main body 24, inlet valves 26A, 26B and 26C, and discharge valves 28A, 28B and 28C. The piezoelectric actuator 20 is provided between the upper pump chamber main body 22 and the lower pump chamber main body 24.

In both sides of the piezoelectric pump 100, in the longitudinal direction of FIGS. 2A–2C, three inlet openings 56A, 56B and 56C and three discharge openings 58A, 58B and 58C are provided between the upper pump chamber main body 22 and the lower pump chamber main body 24. An inlet valve 26A is arranged in the inlet opening 56A. Similarly, an inlet valve 26B is arranged in the inlet opening 56B and an inlet valve 26C is arranged in the inlet opening 56C. A discharge valve 28A is arranged in the discharge opening 58A. Similarly, a discharge valve 28B is arranged in a discharge opening 58B and the discharge valve 28C is arranged in the discharge opening 58C.

The fluid flows into the piezoelectric pump 100 through the inlet openings 56A, 56B and 56C. The fluid flows from the piezoelectric pump 100 through the discharge openings 58A, 58B and 58C.

The inlet valves 26A, 26B and 26C do not affect the inflow of fluid into the piezoelectric pump 100, but prevent the reverse flow, that is, the outflow of the fluid from the piezoelectric pump 100.

The discharge valves 28A, 28B and 28C do not affect the outflow of the fluid from the piezoelectric pump 100 but prevent the reverse flow, that is, the inflow of the fluid into the piezoelectric pump 100.

The piezoelectric actuator 20 comprises a piezoelectric ceramic board 30, positive electrodes 32A, 32B and 32C, negative electrodes 34A, 34B and 34C, and outer insulative layers 36.

The piezoelectric ceramic board 30 is constructed of ferroelectric ceramic materials, such as lead zirconate-titanate (PZT). Such material can be polarized, for example, in the perpendicular direction indicated by the solid line arrows $F_1$ shown in FIG. 1 and FIG. 2.

The positive electrodes 32A, 32B and 32C are made of a metal, such as aluminum, and are arranged on one side of the piezoelectric ceramic board 30. Moreover, each of the positive electrodes 32A, 32B and 32C are arranged on the side of the piezoelectric ceramic board 30 facing the upper pump chambers 38A, 38B and 38C.

The negative electrodes 34A, 34B and 34C are also made of a metal, such as aluminum, and are arranged on the other side of the piezoelectric ceramic board 30 facing the lower pump chambers 40A, 40B and 40C.

The insulative layers 36 are made of a resin material that is coated on the upper and lower surfaces of the piezoelectric ceramic board 30. The insulative layers 36 cover the electrodes so that the positive electrodes 32A, 32B and 32C and the negative electrodes 34A, 34B and 34C do not come into contact with the fluid.

Moreover, the piezoelectric actuator 20 has shape transformable actuator segments 54A, 54B and 54C which are associated with each pair consisting of one of the upper pump chambers 38A, 38B and 38C and a corresponding lower pump chamber 40A, 40B and 40C in a manner to be described later.

The lower pump chamber main body 24 is a rectangularly shaped container which has nine apertures on its upper surface, as shown in FIG. 5, and is made of stainless steel. However, the lower pump chamber main body 24 can be made of other materials, such as resin, ceramic, or rubber, if the material is sufficiently rigid.

The inside center position of the lower pump chamber main body 24 is partitioned into three chambers by the lower pump chamber walls 42A, 42B, 42C and 42D. The three chambers are the lower pump chambers 40A, 40B and 40C. Each lower pump chamber 40A, 40B and 40C, of this embodiment, has a hexahedron shape of 0.5 millimeters in width (longitudinal direction in FIG. 1), 0.3 millimeters in height (vertical direction in FIG. 1), and 10 millimeters in length. However, the size of the lower pump chambers 40A, 40B and 40C is not limited to the above. The upper part of the lower pump chambers 40A, 40B and 40C is open. As shown in FIG. 4, when the piezoelectric actuator 20 is provided on the hollow in the center of the lower pump chamber main body 24, the aperture which is in the upper part of the lower pump chambers 40A, 40B and 40C is closed by the piezoelectric actuator 20.

The inlet passage 46A and the discharge passage 50A are connected to the lower pump chamber 40A. Similarly, the inlet passage 46B and the discharge passage 50B are connected to the lower pump chamber 40B and the inlet passage 46C and the discharge passage 50C are connected to the lower pump chamber 40C. Therefore, as described below, the fluid which flows into the piezoelectric pump 100 from the inlet opening 56A flows into the lower pump chamber 40A through the inlet passage 46A. Moreover, the fluid that is in the lower pump chamber 40A flows through the discharge passage 50A and is discharged from the discharge opening 58A to the outside of the piezoelectric pump 100.

Similarly, the fluid which flows into the piezoelectric pump 100 from the inlet opening 56B flows into the lower pump chamber 40B through the inlet passage 46B. Moreover, the fluid that is in the lower pump chamber 40B flows through the discharge passage 50B and is discharged from the discharge opening 58B to the outside of the piezoelectric pump 100. In addition, the fluid which flows into the piezoelectric pump 100 from the inlet opening 56C flows into the lower pump chamber 40C through the inlet passage 46C. The fluid that is in the lower pump chamber 40C flows through the discharge passage 50C and is discharged from the discharge opening 58C to the outside of the piezoelectric pump 100.

The upper pump chamber main body 22 has the same configuration as the lower pump chamber main body 24 and is a mirror image of the lower pump chamber main body 24. Therefore, the upper pump chamber main body 22 is a rectangularly shaped container having nine apertures on its lower surface and is made of stainless steel. Likewise, the upper pump chamber main body 22 can be made of materials such as resin, ceramic, or rubber, if the material is sufficiently rigid. Preferably, the upper pump chamber main body 22 and the lower pump chamber main body 24 are of the same material.

The inside of the upper pump chamber main body 22 is partitioned to three chambers by the upper pump chamber walls 44A, 44B, 44C and 44D in the same manner as the lower pump chamber main body 24. The three chambers are the upper pump chambers 38A, 38B and 38C. Each of the upper pump chambers 38A, 38B and 38C of this embodiment have hexahedron shape of 0.5 millimeters in width (longitudinal direction in FIG. 1), 0.3 millimeters in height (vertical direction in FIG. 1), and 10 millimeters in length. However, the size of the upper pump chambers 38A, 38B and 38C is not limited to the above. The lower part of the upper pump chambers 38A, 38B and 38C is open.

As shown in FIG. 3, when the upper pump chamber main body 22 and the lower pump chamber main body 24 enclose the piezoelectric actuator 20, the aperture at the bottom of the upper pump chambers 38A, 38B and 38C is closed by the piezoelectric actuator 20.

The inlet passage 48A and the discharge passage 52A are connected to the upper pump chamber 38A. Similarly, the inlet passage 48B and the discharge passage 52B are connected to the upper pump chamber 38B and the inlet passage 48C and the discharge passage 52C are connected to the upper pump chamber 38C. Therefore, as described below, the fluid which flows into the piezoelectric pump 100 through the inlet opening 56A flows into the upper pump chamber 38A through the inlet passage 48A and the fluid that is in the upper pump chamber 38A flows through the discharge passage 52A to be discharged from the discharge opening 58A to the outside of the piezoelectric pump 100.

Similarly, the fluid which flows into the piezoelectric pump 100 through the inlet opening 56B flows into the upper pump chamber 38B through the inlet passage 48B and the fluid that is in the upper pump chamber 38B flows through the discharge passage 52B and is discharged from the discharge opening 58B to the outside of the piezoelectric pump 100. In addition, the fluid which flows into the piezoelectric pump 100 through the inlet opening 56C flows into the upper pump chamber 38C through the inlet passage 48C and the fluid that is in the upper pump chamber 38C flows through the discharge passage 52C and is discharged from the discharge opening 58C to the outside of the piezoelectric pump 100.

Next, the operation of the piezoelectric pump 100 of the first embodiment will be explained with reference to FIGS. 1 through 5. The three actuator segments 54A, 54B and 54C operation will be explained using actuator segment 54B as an example.

First, when the positive voltage and the negative voltage are applied respectively to the positive electrode 32B and the negative electrode 34B of shape transformable actuator segment 54B, of the piezoelectric actuator 20, from a power supply (not shown), a bias electric field is caused in the piezoelectric ceramic board 30 located between the electrodes 32B and 34B. The direction of this electric field is the same as the poling direction, shown in FIG. 1 by the arrow $F_1$, so that the actuator segment 54B is expanded in the direction of the upper pump chamber 38B and the direction of the lower pump chamber 40B according to the thickness expansion mode of shape distortion or transformation of the piezoelectric ceramic board 30, as shown in FIG. I by the dashed lines. Therefore, the volumes of the upper pump chamber 38B and the lower pump chamber 40B are decreased.

Thus, the fluid in the upper and lower pump chambers 38B, 40B receives a positive pressure in accordance with a decrease of the volume of both pump chambers 38B, 40B. The upper pump chamber 38B, which is connected to the inlet passage 48B and the discharge passage 52B, and the lower pump chamber 40B, which is connected to the inlet passage 46B and the discharge passage 50B, so that when the fluid in both pump chambers 38B, 40B receives the positive pressure, the fluid in the inlet passages 46B and 48B and the fluid in the discharge passages 50B and 52B similarly receive the positive pressure.

The fluid which is in the inlet passages 46B, 48B cannot flow out of the pump because of the inlet valve 26B even though the fluid in the inlet passages 46B, 48B receives the positive pressure. Therefore, the fluid in the discharge passages 50B, 52B receiving the positive pressure is discharged from the discharge valve 28B. The discharged fluid is equal in volume to the increased volume of actuator segment 54B of the piezoelectric actuator 20. Therefore, when the discharge of the fluid is not completed with fluid found only in the discharge passages 50B, 52B, additional fluid from pump chambers 38B, 40B is discharged from the discharge valve 28B.

The actuator segment 54B, expanded to the position shown the dashed lines in FIG. 1, returns to its former shape, when the applied voltage from the power supply (not shown) is removed. Therefore, the volume of the upper and lower pump chambers 38B, 40B is increased, compared with the state when the voltage is applied from the power supply. As a result, the fluid in the upper and lower pump chambers 38B, 40B receives a negative pressure due to the increased capacity of both pump chambers 38B, 40B. The upper pump chamber 38B, connected to the inlet passage 48B and the discharge passage 52B, and the lower pump chamber 40B, connected to the inlet passage 46B and the discharge passage 50B, both receive the negative pressure, the fluid in the inlet passages 46B, 48B and the fluid in the discharge passages 50B, 52B similarly receive the negative pressure. The fluid which is in the discharge passages 46B and 48B cannot flow backward from the discharge valve 26B even if a negative pressure is received because of the discharge valve 26B being a one way check valve. Therefore, fluid from outside of the piezoelectric pump 100 flows into the pump 100 through the inlet valve 26B of the inlet opening 56B. As a result, the fluid is replenished from the outside of the piezoelectric pump 100 to the upper lower pump chambers 38B, 40B. The inflow of the fluid from the outside of the piezoelectric actuator 100 ends when the volume of fluid supplied is the same as the decreased volume of the piezoelectric actuator 20.

As explained in detail above, the piezoelectric pump 100 moves the fluid by alternately applying and terminating the voltage from a power supply (not shown) to the positive electrode 32B and the negative electrode 34B.

Although the first embodiment has been explained using the upper and lower pump chambers 38B, 40B and actuator segment 54B as the example, the upper and lower pump chambers 38A and 40A, and upper lower pump chambers 38C, 40C, with their associated actuator segments 54A, 54B respectively can be operated similarly.

That is, the piezoelectric pump 100 of the present embodiment comprises three upper pump mechanisms 60A, 60B and 60C and three lower pump mechanisms 62A, 62B and 62C. The lower pump mechanism 62A and the upper pump mechanism 60A, the lower pump mechanism 62B and the upper pump mechanism 60B and the lower pump mechanism 62C and the upper pump mechanism 60C are driven by the common actuator segment 54A, 54B and 54C. Thus, one piezoelectric actuator extends to comprise a plurality of pump mechanisms thereby providing a structure in which the number of parts is decreased, one that is simple and small, and has decreased manufacturing costs.

Moreover, it is possible to make the pump mechanism even smaller by making the electrode pattern closer, (i.e. more finely subdivided) and high pump efficiency can be obtained even though the pump mechanism is small because two pump chambers are associated with each shape transformable actuator segment. The piezoelectric pump of this embodiment; can be applied to a micropump for supplying many kinds of fluid efficiently, for example, a micropump for supplying different colored inks to a plurality of ejection nozzles of a piezoelectric type color ink jet printer.

The structure of the piezoelectric pump of a second embodiment will now be explained with reference to FIGS. 6 through 10.

Figure 6:
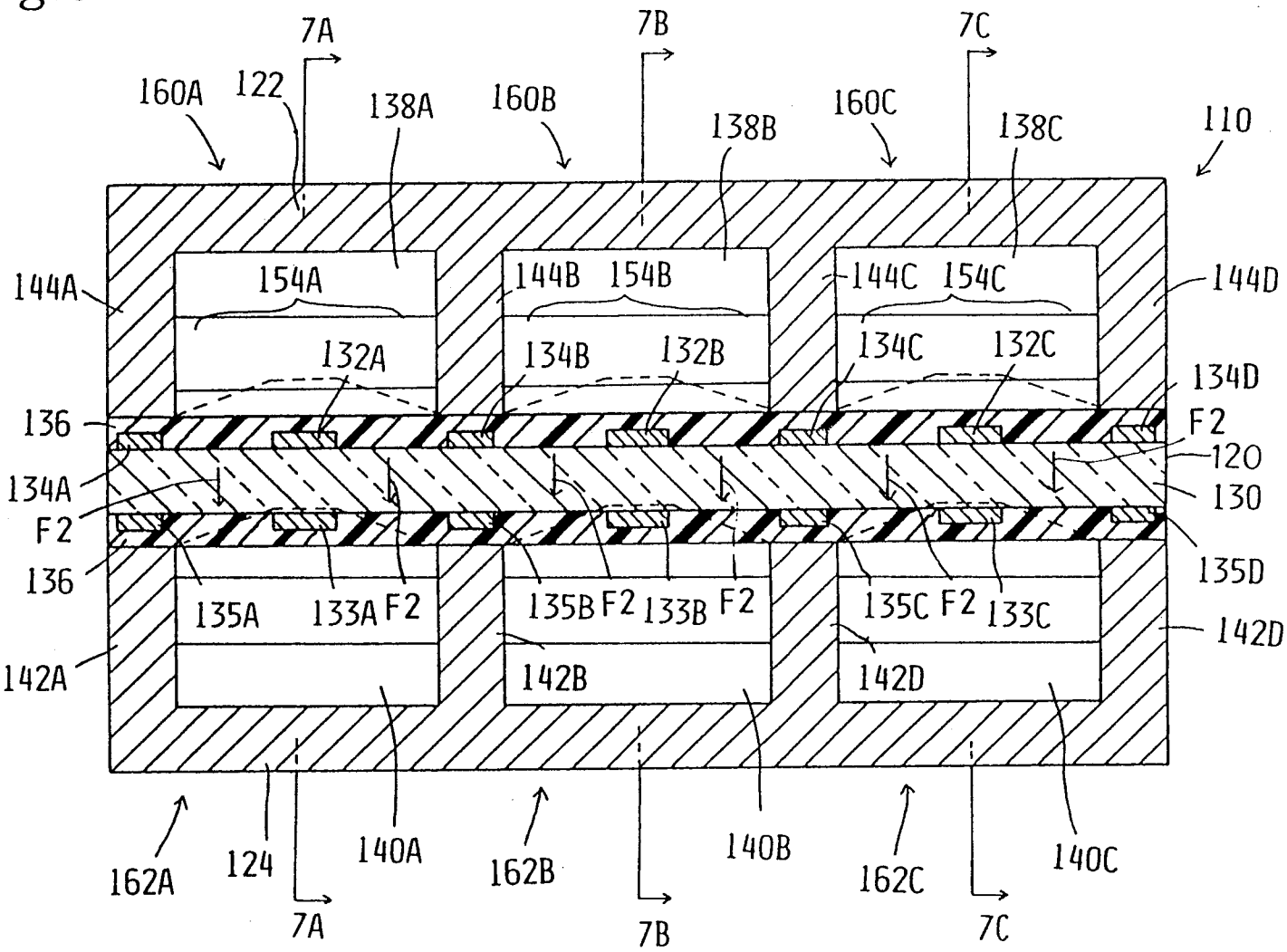
FIG. 6 is a transverse sectional view showing the construction of the piezoelectric pump of a second embodiment of the invention.
Figure 7A:
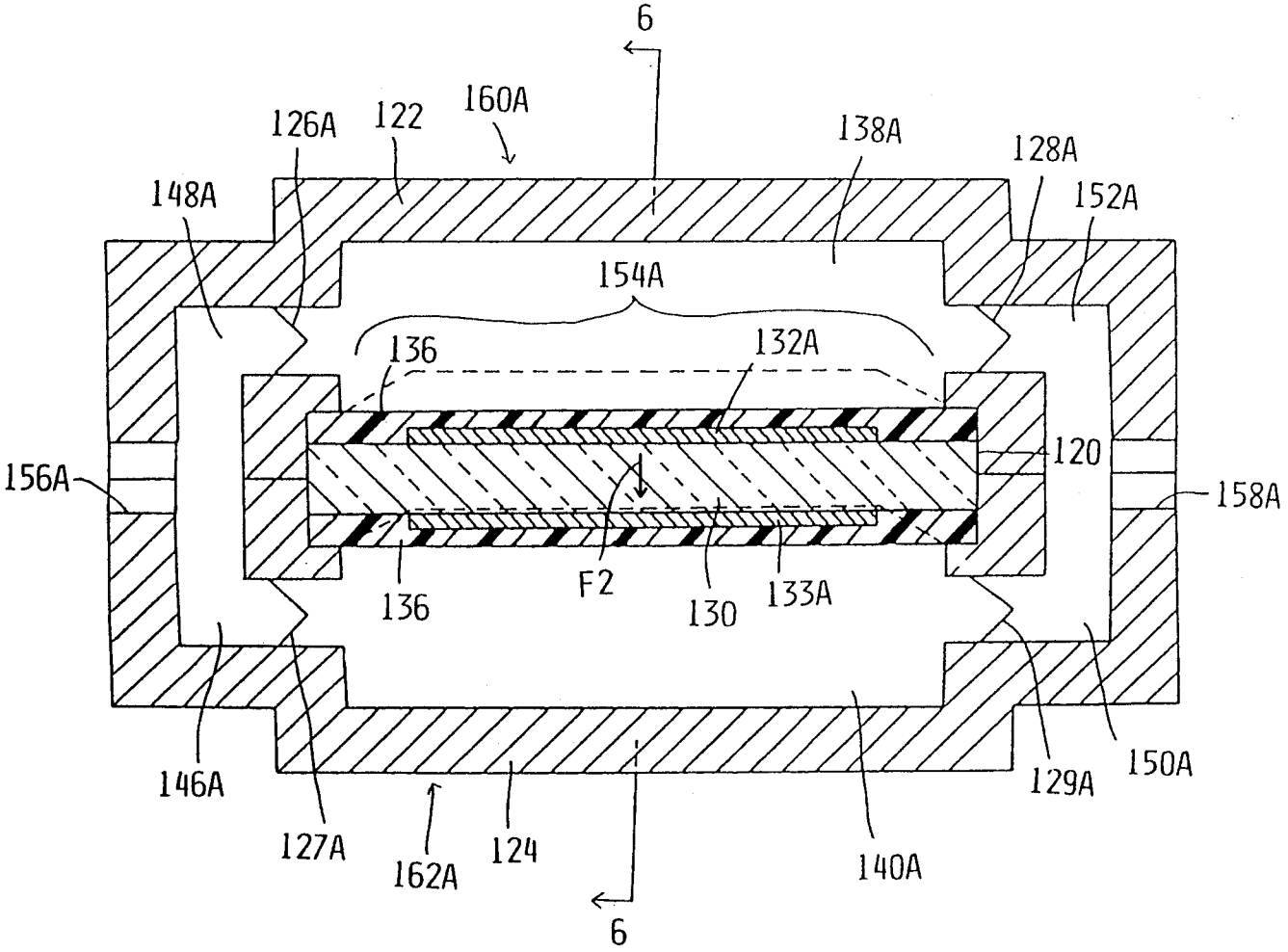
FIGS. 7A–7C are longitudinal sectional views showing the construction of the piezoelectric pump of the second embodiment.
Figure 7B:
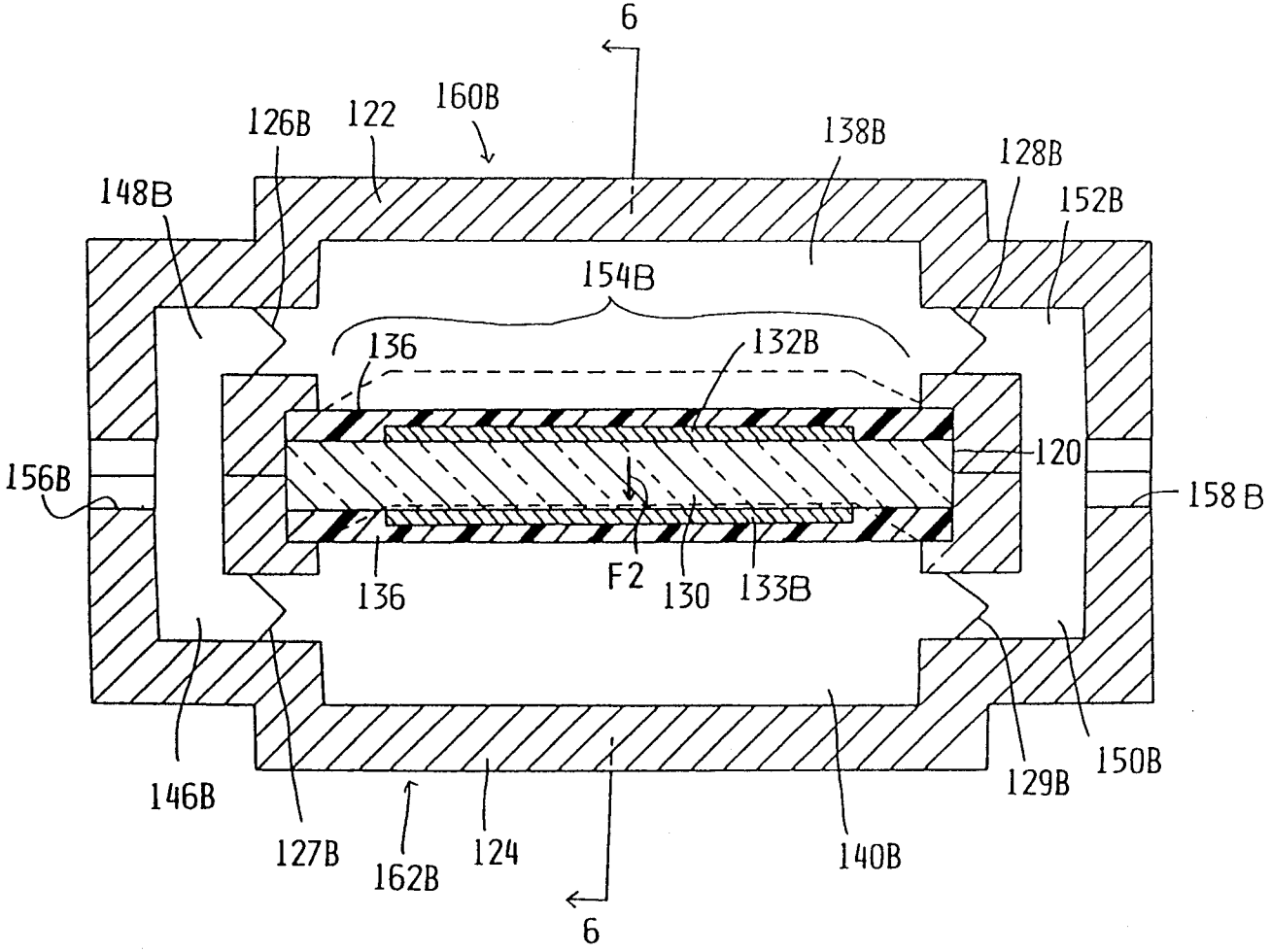
Figure 7C:
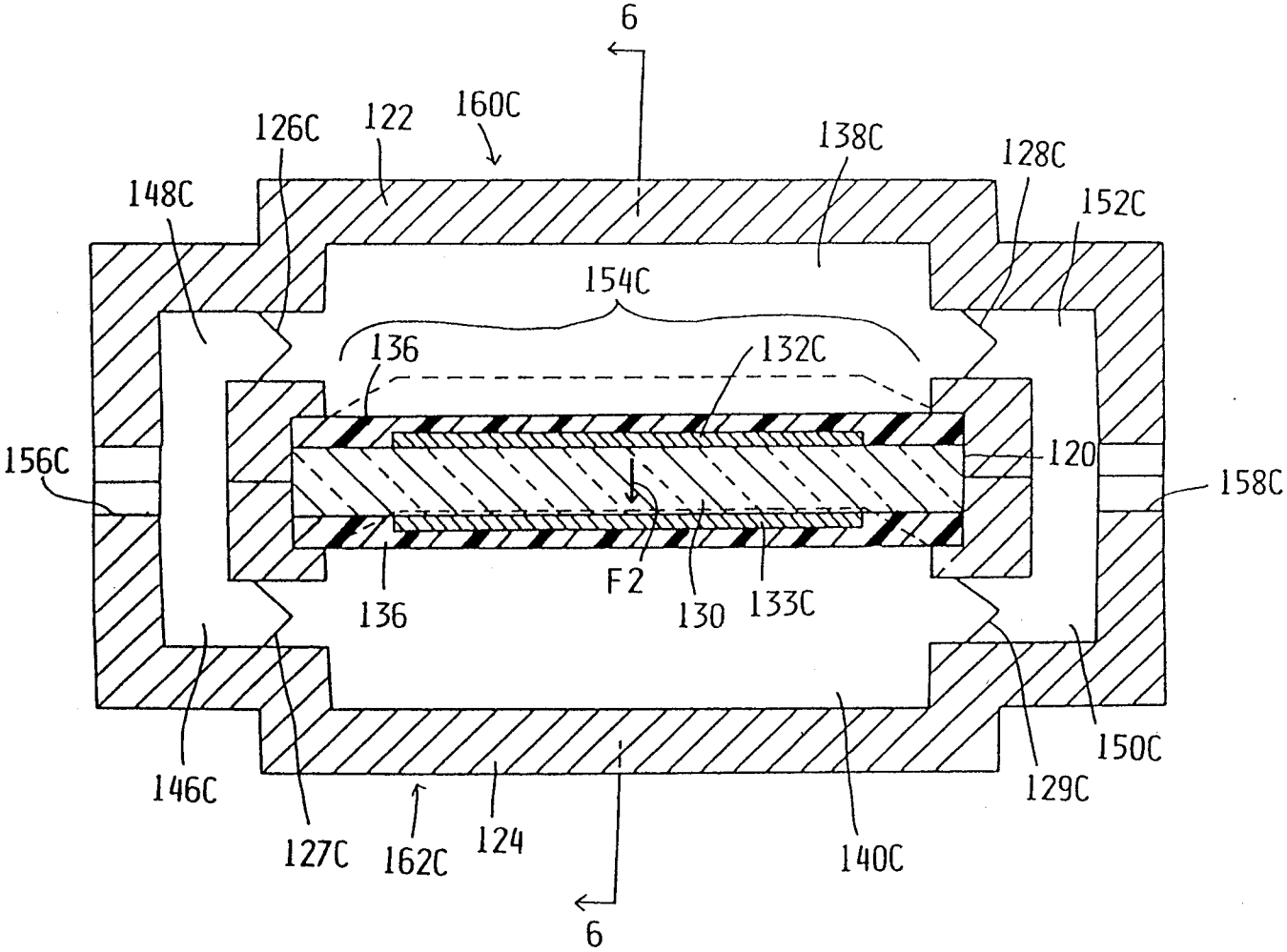
Figure 8:
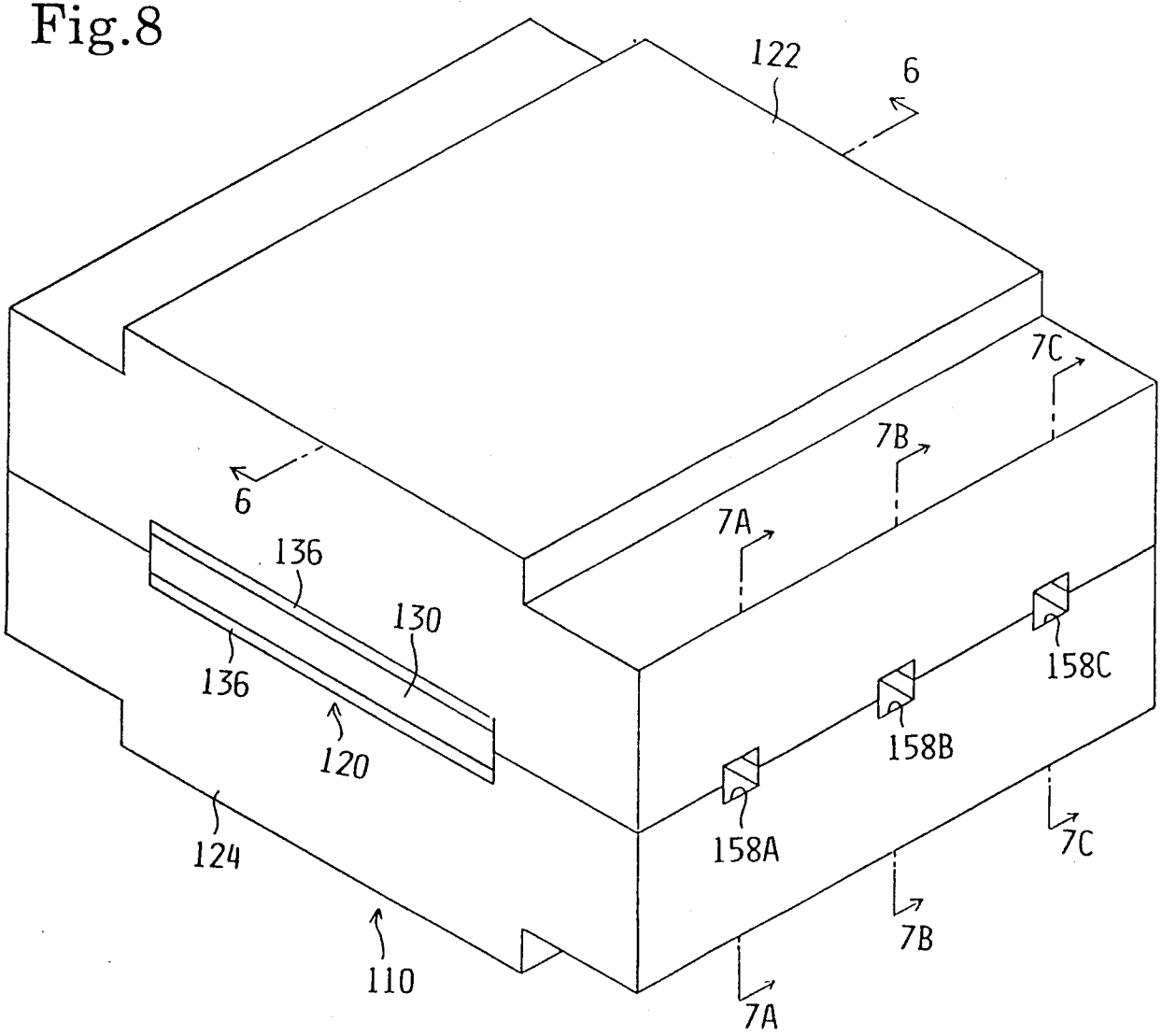
FIG. 8 is a perspective view of the piezoelectric pump of the second embodiment.
Figure 9:
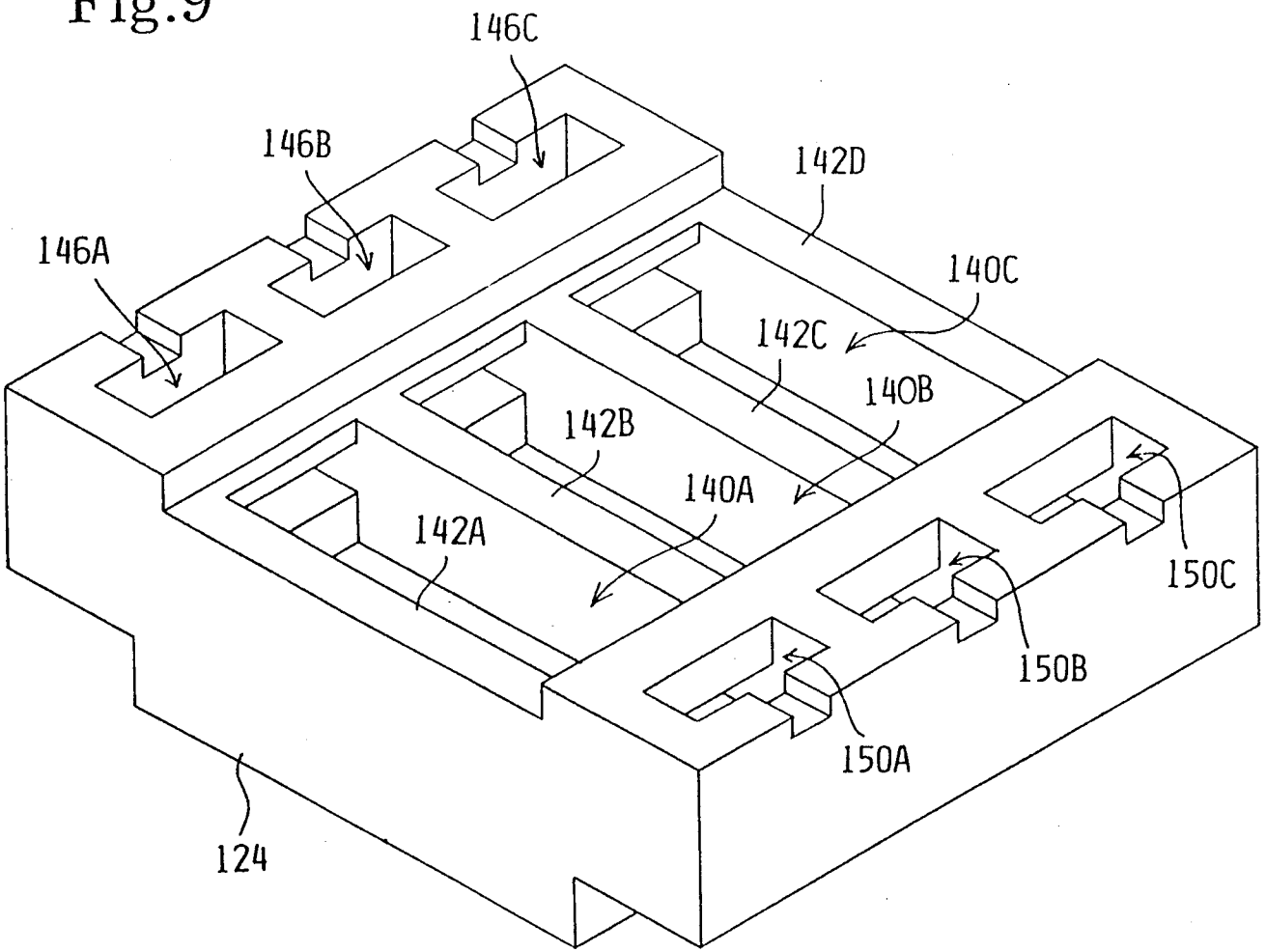
FIG. 9 is a perspective view of the lower pump chamber main body of the second embodiment.
Figure 10:
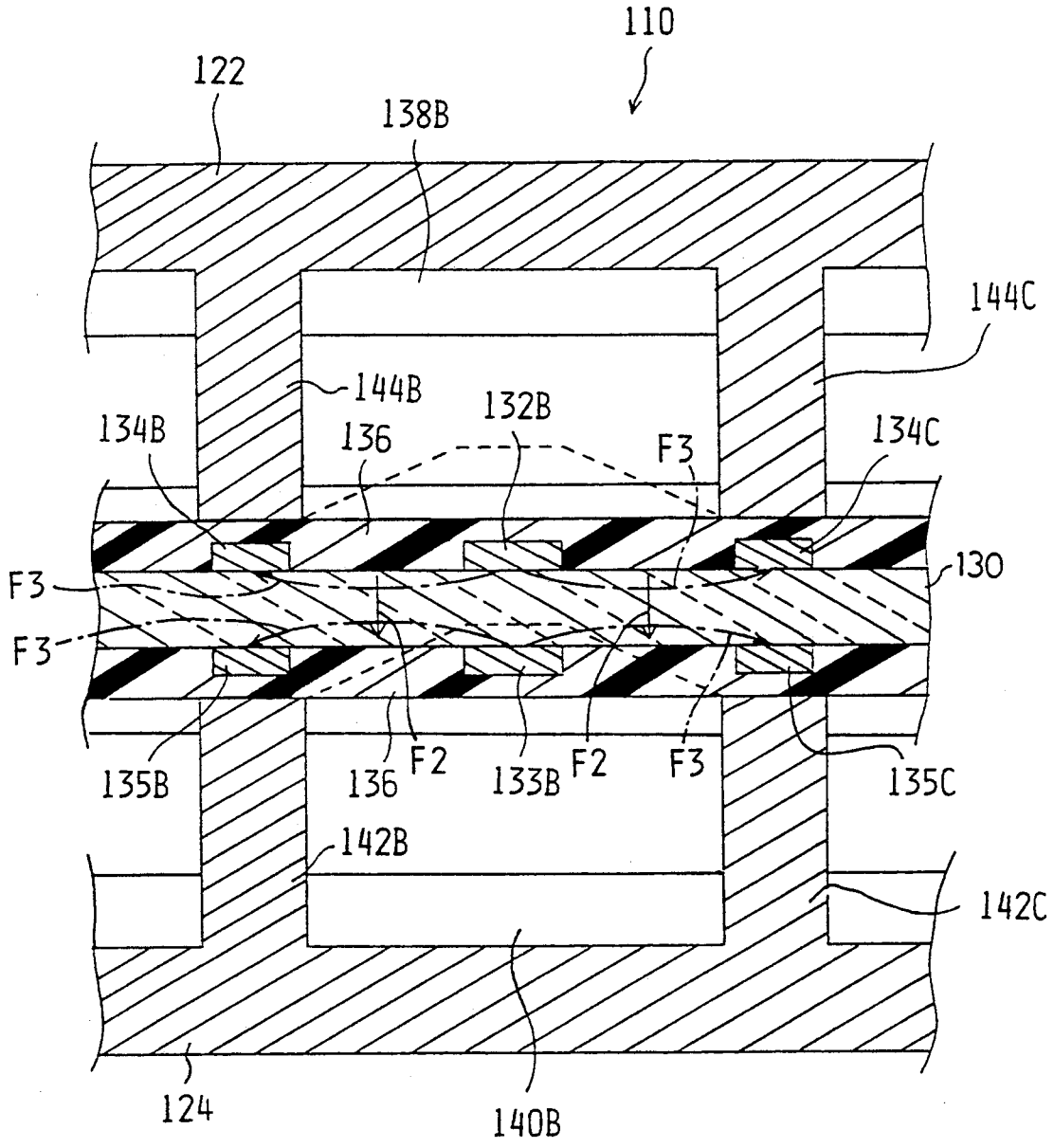
FIG. 10 is a schematic illustration showing the movement of the piezoelectric pump of the second embodiment.
Figure 11:
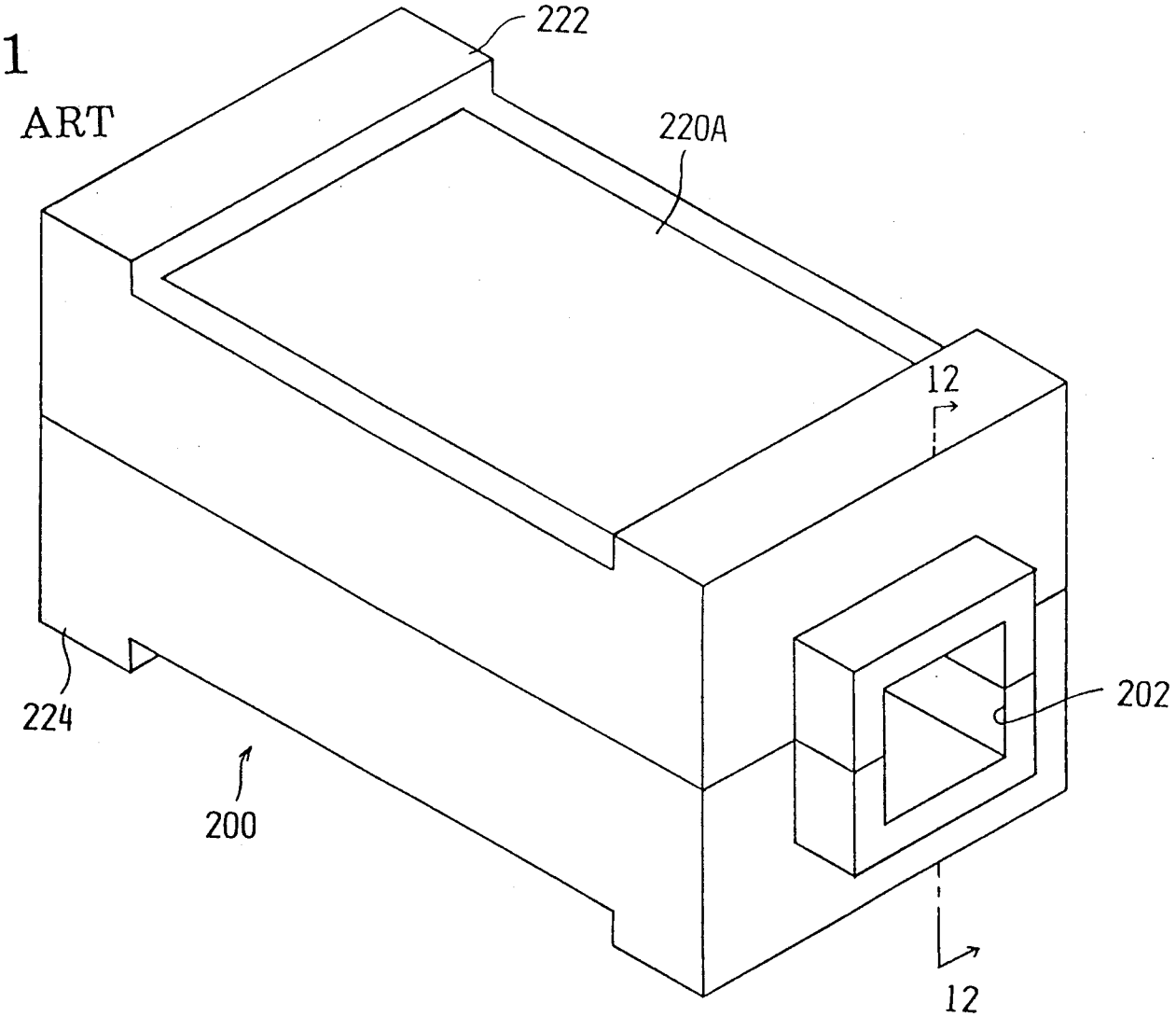
Fig.11 RELATED ART
FIG. 11 is a perspective view showing a conventional piezoelectric pump.
Figure 12:
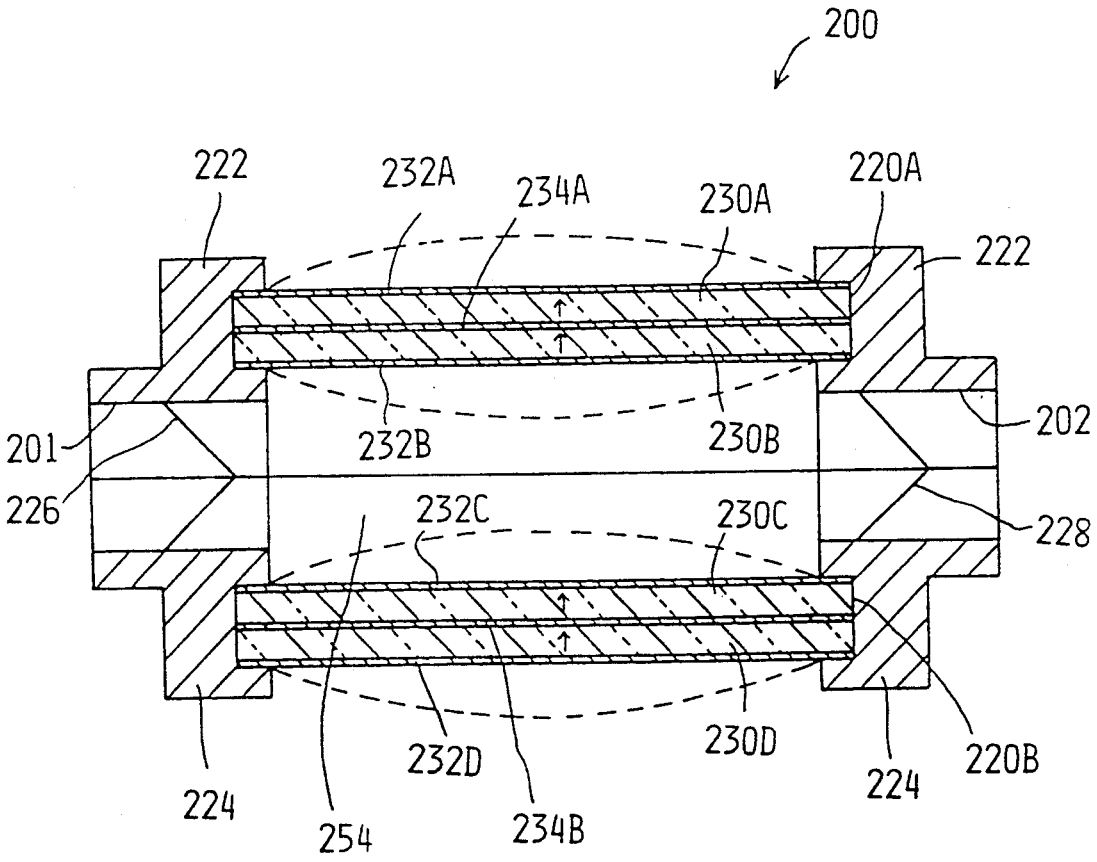
Fig.12 RELATED ART
FIG. 12 is a longitudinal sectional view of the conventional piezoelectric pump of FIG. 11.

FIG. 6 is a transverse sectional view showing the structure of the piezoelectric pump of the second embodiment of the invention. FIGS. 7A–7C are longitudinal sectional views showing the structure of the piezoelectric pump of the second embodiment. FIG. 8 is a perspective view of the piezoelectric pump of the second embodiment. FIG. 9 is a perspective view showing the lower pump chamber main body of the second embodiment. FIG. 10 is a schematic illustration showing the movement of the piezoelectric pump of the second embodiment.

The piezoelectric pump 110 comprises a piezoelectric actuator 120, an upper pump chamber main body 122, a lower pump chamber main body 124, inlet valves 126A, 126B, 126C, 127A, 127B and 127C, and discharge valves 128A, 128B, 128C, 129A, 129B and 129C. The piezoelectric actuator 120 is seated between the upper pump chamber main body 122 and the lower pump chamber main body 124.

In the sides of the piezoelectric pump 110, in the longitudinal direction of FIGS. 7A–7C, are three inlet openings 156A, 156B and 156C and three discharge openings 158A, 158B and 158C that are provided between the upper pump chamber main body 122 and the lower pump chamber main body 124.

The fluid outside of the piezoelectric pump 110 flows into the piezoelectric pump 110, that is, into the upper pump chambers 138A, 138B and 138C and the lower pump chambers 140A, 140B and 140C, through the respectively associated inlet openings 156A, 156B and 156C.

The fluid inside of the piezoelectric pump 110, the fluid in the upper pump chambers 138A, 138B and 138C and the lower pump chambers 140A, 140B and 140C flows out of the piezoelectric pump 110 through the respectively associated discharge openings 158A, 158B and 158C.

Inlet valves 126A, 126B and 126C do not affect the inflow of the fluid into the upper pump chambers 138A, 138B and 138C from outside the piezoelectric pump 110, but prevent the reverse flow, that is, the outflow of the fluid from the upper pump chambers 138A, 138B and 138C to the outside of the piezoelectric pump 110.

Likewise, inlet valves 127A, 127B and 127C do not affect the inflow of fluid into the lower pump chambers 140A, 140B and 140C from the outside, but prevent the reverse flow, that is, the outflow of the fluid from the inside of the lower pump chambers 140A, 140B and 140C to the outside of the piezoelectric pump 110.

Discharge valves 128A, 128B and 128C do not affect the discharge of the fluid from the upper pump chambers 138A, 138B and 138C to outside of the piezoelectric pump 110 but prevent the reverse flow, that is, an inflow of the fluid into the upper pump chambers 138A, 138B and 138C from outside of the piezoelectric pump 110.

Similarly, discharge valves 129A, 129B and 129C do not affect the discharge of the fluid from the lower pump chambers 140A, 140B and 140C to outside of the piezoelectric pump 110 but prevent the reverse flow, that is, an inflow of the fluid into the lower pump chambers 140A, 140B and 140C from the outside of the piezoelectric pump 110.

The piezoelectric actuator 120 comprises a piezoelectric ceramic board 130, three positive electrodes 132A, 132B and 132C, three positive electrodes 133A, 133B and 133C, four upper negative electrodes 134A, 134B, 134C and 134D, four lower negative electrodes 135A, 135B, 135C and 135D, and outer insulative layers 136.

The piezoelectric ceramic board 130 is constructed from ferroelectric ceramic materials such as lead zirconate-titanate (PZT). Such materials can be polarized, for example, in the perpendicular direction indicated by the solid line arrow $F_2$ shown in FIG. 6 and FIG. 10.

The upper positive electrodes 132A, 132B and 132C are made of a metal, such as aluminum, and are arranged on one side of the piezoelectric ceramic board 130. Moreover, each upper positive electrode 132A, 132B and 132C is positioned to face an associated upper pump chamber 138A, 138B or 138C.

The lower positive electrodes 133A, 133B and 133C are also made of a metal, such as aluminum, and are arranged on the other side of the piezoelectric ceramic board 130. The lower positive electrodes 133A, 133B and 133C are positioned so each faces an associated lower pump chamber 140A, 140B or 140C.

The upper negative electrodes 134A, 134B, 134C and 134D are made of a metal, such as aluminum, and are arranged on the same side of the piezoelectric ceramic board 130 as the upper positive electrodes 132A, 132B and 132C. Moreover, each upper negative electrode 134A, 134B, 134C and 134D is arranged to confront an associated upper pump chamber wall 144A, 144B, 144C or 144D.

The lower negative electrodes 135A, 135B, 135C and 135D are made of a metal, such as aluminum, and are arranged on the same side of the piezoelectric ceramic board 130 as the lower positive electrodes 133A, 133B and 133C. Moreover, each lower negative electrode 135A, 135B, 135C, and 135D is arranged to confront an associated lower pump chamber wall 142A, 142B, 142C or 142D.

The insulative layers 136 are made of the resin material, and are coated on the upper and lower surfaces of the piezoelectric ceramic board 130. The insulative layer 136 perfectly covers the electrodes so that the upper positive electrodes 132A, 132B and 132C; the lower positive electrodes 133A, 133B and 133C; the upper negative electrodes 134A, 134B, 134C, and 134D; and the lower negative electrodes 135A, 135B, 135C and 135D do not come in contact with the fluid.

Moreover, the piezoelectric actuator 120 has the actuator segments 154A, 154B and 154C which correspond to a pair of pump chambers comprising one of the upper pump chambers 138A, 138B and 138C and a corresponding one of the lower pump chambers 140A, 140B and 140C.

A description of the physical structure of the lower pump chamber main body 124 shown in FIG. 9 is omitted as it is identical to that of lower pump chamber main body 24 of FIG. 5 with the exception that 100 has been added to the reference numbers of FIG. 5 to produce the reference numbers of FIG. 9.

When the piezoelectric actuator 120 is mounted on the hollow in the center of the lower pump chamber main body 124, the aperture which is in the upper part of the lower pump chambers 140A, 140B and 140C is closed by the piezoelectric actuator 120. Moreover, the inlet passage 146A and the discharge passage 150A are connected to the lower pump chamber 140A. The inlet valve 127A is mounted in the inlet passage 146A and the discharge valve 129A is mounted in the discharge passage 150A.

Similarly, the inlet passage 146B and the discharge passage 150B are connected to the lower pump chamber 140B, with the inlet valve 127B installed in the inlet passage 146B and the discharge valve 129B installed in the discharge passage 150B. Further, the inlet passage 46C and the discharge passage 50C are connected to the lower pump chamber 40C and the inlet valve 127C is installed in the inlet passage 146C and the discharge valve 129C is installed in the discharge passage 150C. Therefore, as described below, the fluid which flows into the piezoelectric pump 110 from the inlet opening 156A flows into the lower pump chamber 140A through the inlet passage 146A. Moreover, the fluid which is in the lower pump chamber 140A flows through the discharge passage 150A to be discharged from the discharge opening 158A to the outside of the piezoelectric pump 110. The fluid flow in the other lower pump chambers 140B, 140C of the piezoelectric pump 110 occurs in a similar manner.

The upper pump chamber main body 122 has same physical structure as the lower pump chamber main body 124 and is a mirror image of that of the lower pump chamber main body 124. The description of the physical structure of the upper pump chamber is identical to that of upper pump chamber main body 22 of the first embodiment except the structural parts bear reference numbers to which 100 has been added. Thus, for a physical description of the upper pump chamber main body 122 refer to that of upper pump chamber main body 22.

The lower part of the upper pump chambers 138A, 138B and 138C is open. As shown in FIG. 8, when the upper pump chamber main body 122 and the lower pump chamber main body 124 enclose the piezoelectric actuator 120, the aperture under the upper pump chambers 138A, 138B and 138C is closed by the piezoelectric actuator 120.

The inlet valve 126A is installed in the inlet passage 148A and the discharge valve 128A is installed in the discharge passage 152A that are connected to upper pump chamber 138A. Similarly, the inlet passage 148B and the discharge passage 152B are connected to the upper pump chamber 138B with the inlet valve 126B installed in the inlet passage 148B and the discharge valve 128B installed in the discharge passage 152B. Further, the inlet passage 148C and the discharge passage 152C are connected to the upper pump chamber 138C with the inlet valve 126C installed in the inlet passage 148C and the discharge valve 128C installed in the discharge passage 152C.

As a result, fluid that flows into the piezoelectric pump 110 through the inlet opening 156A flows into the upper pump chamber 138A through the inlet passage 148A and the fluid that is in the upper pump chamber 138A flows through the discharge passage 152A and is discharged from the discharge opening 158A to the outside of the piezoelectric pump 110. Similarly, the fluid that flows into the piezoelectric pump 110 through the inlet opening 156B flows into the upper pump chamber 138B through the inlet passage 148B and the fluid that is in the upper pump chamber 138B flows through the discharge passage 152B to be discharged from the discharge opening 158B to the outside of the piezoelectric pump 110. In the same manner, the fluid which flows into the piezoelectric pump 110 through the inlet opening 156C flows into the upper pump chamber 138C through the inlet passage 148C and the fluid that is in the upper pump chamber 138C flows through the discharge passage 152C and is discharged from the discharge opening 158C to the outside of the piezoelectric pump 110.

The operation of the piezoelectric pump 100 of the second embodiment will be explained with reference to FIGS. 6 through 10. The three actuator segments 154A, 154B and 154C will be explained using actuator segment 154B as an example.

First, a positive voltage is applied to the upper positive electrode 132B and the lower positive electrode 133B of the piezoelectric actuator 120 from a power supply (not shown). A negative voltage is applied to the upper negative electrodes 134B, 134C and the lower negative electrodes 135B, 135C from the power supply (not shown). A bias electric field is produced in the piezoelectric ceramic board 130 located between the upper positive electrode 132B and the upper negative electrodes 134B, 134C. The directions of the electric fields are the directions indicated by the arrows $F_3$, which are substantially transverse to the poling direction shown in FIG. 10 by the solid line arrows $F_2$. The actuator segment 154B is flexed in the direction of and into the upper pump chamber 138B according to the thickness shear mode of shape distortion or transformation of the piezoelectric ceramic board 130 as shown in FIG. 10 by dashed lines. Thus, the volume, or fluid capacity, of the upper pump chamber 138B is decreased. At the same time, the volume, or fluid capacity, of the lower pump chamber 140B is increased.

As a result, the fluid in the upper pump chamber 138B receives a positive pressure in accordance with the decrease in volume of the pump chamber 138B. The fluid which is in the upper pump chamber 138B cannot flow backward through the inlet valve 26B, a one way value, even though the fluid in the upper pump chamber 138B receives the positive pressure. Therefore, the fluid which is in the upper pump chamber 138B is discharged from the discharge valve 128B. The discharge of the fluid ends when the fluid removed from upper pump chamber 138B by the flexion of the piezoelectric actuator 120, that is the decreased volume in the upper pump chamber 138B produces a discharge equal to the reduction volume through the discharge valve 128B.

On the other hand, the fluid in the lower pump chamber 140B receives a negative pressure in accordance with an increase of the volume or capacity of the lower pump chamber 140B. The fluid cannot flow from the discharge valve 129B, because it is a one way valve, even if the fluid in the lower pump chamber 140B receives the negative pressure. Therefore, fluid from outside of the piezoelectric pump 110 flows into the lower pump chamber 140B through the inlet valve 127B. The inflow of the fluid from outside of the piezoelectric actuator 110 ends when the fluid in the lower pump chamber 140B is of the same volume or fluid capacity as that of the lower pump chamber 140B resulting from the upward flexion of the piezoelectric actuator 120. As a result of applying the current, the fluid is discharged from the upper pump chamber 138B to the outside of the piezoelectric pump 110 through the discharge valve 128B and the fluid is drawn from outside of the piezoelectric pump 110 into the lower pump chamber 140B through the inlet valve 127B.

Moreover, the actuator segment 154B returns to its rest or base position when the application of the voltage to the upper positive electrode 132B, the lower positive electrode 133B, and the upper negative electrodes 134B, 134C and the lower negative electrodes 135B, 135C is stopped. At that time the volume or fluid capacity of the upper pump chamber 138B increases and the volume or fluid capacity of the lower pump chamber 140B decreases. As a result, the fluid in the upper pump chamber 138B receives a negative pressure in accordance the increased capacity of the upper pump chamber 138B and the fluid from outside of the piezoelectric pump 110 flows into the upper pump chamber 138B through the inlet valve 126B, the fluid being unable to enter the upper pump chamber 138B through discharge valve 128B. The inflow of the fluid ends when the fluid volume equals the increased volume of the upper pump chamber 138B resulting from the downward flexion of the piezoelectric actuator 120.

At the same time, the fluid in the lower pump chamber 140B receives a positive pressure in accordance with the decrease in the volume or fluid capacity of the lower pump chamber 140B. The fluid in the lower pump chamber 140B cannot escape through the inlet valve 127B so it is discharged from the discharge valve 129B. The discharge of the fluid ends when the fluid remaining in the lower pump chamber 140B is of the same volume as the reduced volume of the lower pump chamber 140B resulting from the downward flexion of the piezoelectric actuator 120 as it returns to its rest position.

Thus, the fluid flows from the outside of the piezoelectric pump 110 into the upper pump chamber 138B through the inlet valve 128B and the fluid is discharged from the lower pump chamber 140B to the outside of the piezoelectric pump 110 through the discharge valve 129B.

Although the second embodiment has been explained using the upper pump chamber 138B, the lower pump chamber 140B and actuator segment 154B; the upper pump chamber 138A, the lower pump chamber 140A, and actuator segment 154A; and the upper pump chamber 138C, the lower pump chamber 140C, and actuator segment 154C can be operated similarly.

That is, the piezoelectric pump 110 of the present embodiment comprises three upper pump mechanisms 160A, 160B and 160C and three lower pump mechanisms 162A, 162B and 162C. The lower pump mechanism 162A and the upper pump mechanism 160A; the lower pump mechanism 162B and the upper pump mechanism 160B; and the lower pump mechanism 162C and the upper pump mechanism 160C form three paired assembles that are driven by respective associated actuator segments 154A, 154B and 154C. Thus, two pump chambers are associated with each actuator segment of the piezoelectric actuator so that the resultant piezoelectric pump has a decreased number of parts, a structure that is simple and small, and manufacturing costs that are decreased as compared to previously known such devices.

It is possible to make the pump mechanism yet smaller by decreasing the distance between the electrodes. Further, this embodiment of the invention provides for the simultaneous discharge of fluid from one pump chamber and the supply of fluid to a second pump chamber when the drive voltage is applied to the actuator segment or is terminated. Thus, discharge of fluid from a pump chamber and supply of fluid to a second pump chamber is performed twice during one cycle of applying and terminating the drive voltage to the actuator segment.

It is to be understood that the present invention is not restricted to the particular forms shown in the foregoing embodiments, and various modifications and alterations can be added thereto without departing from the scope of the invention encompassed by the appended claims.

For example, a laminated piezoelectric device which has an internal electrode can be used as a piezoelectric actuator with the actuator segment.

Moreover, although a positive voltage was applied to the positive electrode and a negative voltage was applied to the negative electrode in the above first and second embodiments, it is possible to apply an alternating voltage to both electrodes for driving the transformable piezoelectric actuator. In this case, the shape transformable actuator first undergoes a deformation in a first direction, followed by a deformation in the second direction. That is, in the first embodiment, the shape transformable actuator is first expanded, with voltage applied in a first polarity, and then shrunk less than its original shape by a voltage of opposite polarity. In the second embodiment, the shape transformable actuator first extends into one of the chambers and, when the voltage is reversed, extends into the opposite chamber. This enhances the pumping capacity of the pump.

The shape distortion characteristics of ferroelectric piezoelectric ceramics are known and are described in *Electric Engineers' Hand Book*, 3rd Edition paragraphs 7-26 to 7-29, D. G. Fink and D. Christiansen, McGraw-Hill Inc., 1989.

Throughout this discussion terms such as upper and lower have been used. However, these terms are not to be construed as limitations to be taken literally, rather they are used with respect to the figures to facilitate the description. The orientation of the pump in use, is a function of that use and the apparatus with which it is used.

What is claimed is:

1. A piezoelectric pump, comprising:

an upper pump chamber main body which has at least one upper pump chamber;

a lower pump chamber main body which has at least one lower pump chamber; and a piezoelectric actuator which is supported between said upper pump chamber main body and said lower pump chamber main body, said piezoelectric actuator having a unitary actuator segment of piezoelectric material extending between the upper pump chamber and the lower pump chamber, said piezoelectric actuator being capable of transformation in one of a thickness expansion mode and a thickness shear mode.

2. The piezoelectric pump according to claim 1, wherein said upper pump chamber and said lower pump chamber are defined by a plurality of walls, one of the plurality of walls of said upper pump chamber and one of the plurality of walls of said lower pump chamber comprises said piezoelectric actuator.

3. The piezoelectric pump according to claim 2, wherein said one of the plurality of walls of said upper pump chamber and said one of the plurality of walls of said lower pump chamber comprise said actuator segment.

4. The piezoelectric pump according to claim 3, said piezoelectric pump further comprising:

at least one inlet opening for drawing fluid from the outside into said piezoelectric pump; and at least one discharge opening for discharging fluid from the inside of said piezoelectric pump to the outside;

wherein said inlet opening and said discharge opening are formed by said upper pump chamber main body and said lower pump chamber main body.

5. The piezoelectric pump according to claim 4, said piezoelectric pump further comprising:

at least one inlet valve being arranged in said inlet opening; and at least one discharge valve being arranged in said discharge opening.

6. The piezoelectric pump according to claim 4, said piezoelectric pump further comprising:

a first passage for connecting said inlet opening with said upper pump chamber;

a second passage for connecting said upper pump chamber with said discharge opening;

a third passage for connecting said inlet opening with said lower pump chamber; and a fourth passage for connecting said lower pump chamber with said discharge opening.

7. The piezoelectric pump according to claim 6, said piezoelectric pump further comprising:

an inlet valve being arranged in each of said first and said third passages; and a discharge valve being arranged in each of said second and said fourth passages.

8. The piezoelectric pump according to claim 1, wherein said piezoelectric actuator comprises:

a piezoelectric ceramic board;

at least one electrode being provided on each side of said actuator segment of said piezoelectric ceramic board; and an insulative layer being coated on each side of said piezoelectric ceramic board, each said insulative layer covering said at least one electrode.

9. The piezoelectric pump according to claim 8, wherein said piezoelectric ceramic board is ferroelectric and is polarized in a predetermined direction.

10. The piezoelectric pump according to claim 9, wherein said piezoelectric ceramic board is planar and said predetermined direction is perpendicular to the plane of said board.

11. The piezoelectric pump according to claim 10, wherein at least one electrode on a first side of said piezoelectric ceramic board is applied with a positive voltage and said at least one electrode on a second side of said piezoelectric ceramic board is applied with a negative voltage.

12. The piezoelectric pump according to claim 11 wherein said actuator segment is transformed according to a thickness expansion mode of said piezoelectric ceramic board.

13. The piezoelectric pump according to claim 1, wherein said upper pump chamber main body and said lower pump chamber main body have a plurality of chamber walls respectively, said chamber walls partition an inside of said upper pump chamber main body and said lower pump chamber main body into at least two chambers respectively.

14. The piezoelectric pump according to claim 13, wherein said piezoelectric actuator comprises:

a piezoelectric ceramic board;

at least one first electrode being provided on each side of said actuator segment of said piezoelectric ceramic board;

at least two second electrodes being provided on each side of said piezoelectric ceramic board in positions opposite to said walls; and an insulative layer being coated on both surfaces of said piezoelectric ceramic board, each said insulative layer covering said first and said second electrodes on a side of the piezoelectric board on which they are coated.

15. The piezoelectric pump according to claim 14, wherein said piezoelectric ceramic board is ferroelectric and is polarized in a predetermined direction.

16. The piezoelectric pump according to claim 15, wherein said piezoelectric board is substantially planar and said predetermined direction is perpendicular to the plane of said piezoelectric board.

17. The piezoelectric pump according to claim 16, wherein said first electrodes are applied with a first voltage and said second electrodes are applied with a second voltage having a opposite polarity of said first voltage.

18. The piezoelectric pump according to claim 17, wherein said actuator segment is transformed according to the thickness shear mode of said piezoelectric ceramic board.

19. A piezoelectric pump, comprising:

an upper pump chamber main body which has at least one upper pump chamber defined by a plurality of walls;

a lower pump chamber main body which has at least one lower pump chamber defined by a plurality of walls;

a piezoelectric actuator which is supported between said upper pump chamber main body and said lower pump chamber main body, said piezoelectric actuator having at least one actuator segment, said at least one actuator segment comprising one of the plurality of walls of the upper pump chamber and one of the walls of the lower pump chamber;

at least one inlet opening for drawing fluid from the outside into said piezoelectric pump; and at least one discharge opening for discharging fluid from the inside of said piezoelectric pump to the outside;

wherein said inlet opening and said discharge opening are formed by said upper pump chamber main body and said lower pump chamber main body; and a first passage for connecting said inlet opening with said upper pump chamber;

a second passage for connecting said upper pump chamber with said discharge opening;

a third passage for connecting said inlet opening with said lower pump chamber; and a fourth passage for connecting said lower pump chamber with said discharge opening.

20. The piezoelectric pump according to claim 19, said piezoelectric pump further comprising:

an inlet valve being arranged in each of said first and said third passages; and a discharge valve being arranged in each of said second and fourth passages.

21. A piezoelectric pump, comprising:

an upper pump chamber main body which has at least one upper pump chamber a lower pump chamber main body which has at least one lower pump chamber;

wherein said upper pump chamber main body and said lower pump chamber main body have a plurality of chamber walls respectively, said chamber walls partition an inside of said upper pump chamber main body and said lower pump chamber main body into at least two chambers respectively;

a piezoelectric actuator which is supported between said upper pump chamber main body and said lower pump chamber main body, said piezoelectric actuator having at least one actuator segment and, wherein said piezoelectric actuator comprises:

a piezoelectric ceramic board;

at least one first electrode being provided on each side of said actuator segment of said piezoelectric ceramic board;

at least two second electrodes being provided on each side of said piezoelectric ceramic board in positions opposite to said walls; and an insulative layer being coated on both surfaces of said piezoelectric ceramic board, each said insulative layer covering said first and said second electrodes on a side of the piezoelectric board on which they are coated.

22. The piezoelectric pump according to claim 21, wherein said piezoelectric ceramic board is ferroelectric and is polarized in a predetermined direction.

23. The piezoelectric pump according to claim 22, wherein said piezoelectric board is substantially planar and said predetermined direction is perpendicular to the plane of said piezoelectric board.

24. The piezoelectric pump according to claim 23, wherein said first electrodes are applied with a first voltage and said second electrodes are applied with a second voltage having a opposite polarity of said first voltage.

25. The piezoelectric pump according to claim 24, wherein said actuator segment is transformed according to the thickness shear mode of said piezoelectric ceramic board.

* * * * *